US012214271B2

(12) United States Patent
Yoo

(10) Patent No.: US 12,214,271 B2
(45) Date of Patent: Feb. 4, 2025

(54) SENSOR MODULE AND WEIGHT EXERCISE APPARATUS INCLUDING THE SAME

(71) Applicant: DRAX INC., Anyang-si (KR)

(72) Inventor: Seon Kyung Yoo, Seoul (KR)

(73) Assignee: DRAX INC., Anyang-si (KR)

( * ) Notice: Subject to any disclaimer, the term of this patent is extended or adjusted under 35 U.S.C. 154(b) by 253 days.

(21) Appl. No.: 18/089,046

(22) Filed: Dec. 27, 2022

(65) Prior Publication Data

US 2023/0201694 A1 Jun. 29, 2023

(30) Foreign Application Priority Data

Dec. 28, 2021 (KR) ..... 10-2021-0190354
Dec. 28, 2021 (KR) ..... 10-2021-0190355
Nov. 14, 2022 (KR) ..... 10-2022-0151982

(51) Int. Cl.
*A63B 71/06* (2006.01)

(52) U.S. Cl.
CPC .... *A63B 71/0619* (2013.01); *A63B 2071/065* (2013.01); *A63B 2220/10* (2013.01);
(Continued)

(58) Field of Classification Search
CPC ..... A63B 21/0628; A63B 21/063; A63B 2220/10; A63B 2220/20; A63B 2220/52;
(Continued)

(56) References Cited

U.S. PATENT DOCUMENTS 9,409,053 B1 * 8/2016 Todd ..... G16H 20/30
11,135,477 B1 * 10/2021 Kneknas ..... G01B 21/24
(Continued)

FOREIGN PATENT DOCUMENTS

CN 108159632 A 6/2018
JP 2012-170754 A 9/2012
(Continued)

OTHER PUBLICATIONS

Extended European Search Report dated May 19, 2023 in Application No. 22216535.9.
(Continued)

*Primary Examiner* — Megan Anderson
*Assistant Examiner* — Jonathan A Dicuia
(74) *Attorney, Agent, or Firm* — Sughrue Mion, PLLC

(57) ABSTRACT

Provided is a weight exercise apparatus. The weight exercise apparatus includes an exercise main body in which movement occurs according to the user's weight exercise, a sensor module detecting movement of the exercise main body, and a processor configured to control a UI unit to display a UI element indicating an exercise state of a user corresponding to the detected movement on a UI screen, wherein the sensor module includes a first laser sensor comprising a first measurement accuracy and a first measurement frequency to detect weight setting of the exercise main body when the weight plate is in a stationary state and a second laser sensor comprising a second measurement accuracy lower than the first measurement accuracy and a second measurement frequency higher than the first measurement frequency to detect movement of the weight plate when the weight plate is in a moving state.

19 Claims, 21 Drawing Sheets

(52) U.S. Cl.
CPC ..... *A63B 2220/20* (2013.01); *A63B 2220/52* (2013.01); *A63B 2220/805* (2013.01)

(58) Field of Classification Search
CPC ..... A63B 2220/805; A63B 2220/13; A63B 2220/62; A63B 2220/64; A63B 2220/72; A63B 2220/75; A63B 71/06; A63B 71/0619; A63B 2071/065; A63B 2225/50
See application file for complete search history.

(56) References Cited

U.S. PATENT DOCUMENTS

| | | | |
|---|---|---|---|
| 2012/0220429 | A1 | 8/2012 | Yoshida et al. |
| 2015/0209609 | A1 | 7/2015 | Oteman |
| 2017/0368413 | A1 | 12/2017 | Shavit |
| 2020/0316434 | A1 | 10/2020 | Bengtsson et al. |
| 2020/0342975 | A1 | 10/2020 | Bengtsson et al. |
| 2021/0124028 | A1 | 4/2021 | Linge et al. |
| 2022/0387853 | A1 | 12/2022 | Semegen et al. |

FOREIGN PATENT DOCUMENTS

| | | | | |
|---|---|---|---|---|
| JP | 2019109109 | A | * | 7/2019 |
| KR | 10-1819346 | B1 | | 1/2018 |
| KR | 10-2019-0099556 | A | | 8/2019 |
| WO | 2021/122245 | A1 | | 6/2021 |
| WO | WO-2022005062 | A1 | * | 1/2022 |

OTHER PUBLICATIONS

Communication dated Jul. 16, 2024, issued in Korean Application No. 10-2022-0151982.
Communication issued Sep. 24, 2024 by The State Intellectual Property Office of People's Republic of China in application No. 202211687134.6.

* cited by examiner

SENSOR MODULE AND WEIGHT EXERCISE APPARATUS INCLUDING THE SAME

CROSS-REFERENCE TO RELATED APPLICATIONS

This application is based on and claims priority under 35 U.S.C. § 119 to Korean Patent Application No. 10-2021-0190354, filed on Dec. 28, 2021, Korean Patent Application No. 10-2021-0190355, filed on Dec. 28, 2021, and Korean Patent Application No. 10-2022-0151982, filed on Nov. 14, 2022, in the Korean Intellectual Property Office, the disclosures of which are incorporated by reference herein in their entireties.

BACKGROUND

1. Field

The disclosure relates to a sensor module and a weight exercise apparatus including the same.

2. Description of the Related Art

Generally, as the standard of living improves, interest in health is gradually increasing, and thus many people use various types of weight exercise apparatuses to improve physical strength.

The weight exercise apparatuses have been provided in various forms depending on a body part to be improved in muscular strength, a purpose of use, etc., and are intended to train an upper body and a lower body mainly using hands or feet. Various types of weight exercise apparatuses, such as shoulder presses, bench presses, abdominal machines, butterfly machines, arm curl machines, etc., have been used depending on the body part to be improved in its muscle strength.

The weight exercise apparatus is installed such that a plurality of weight plates in a block form overlap each other, and the weight exercise apparatus may include a pin structure for selecting some of the plurality of weight plates. A user may use the pin structure to select the number of weight plates or a weight of a weight plate to be lifted. The user may exercise by moving a selected weight through an exercise structure of exercise equipment.

However, when exercising using a weight exercise apparatus, the user may have a difficulty in accurately identifying an exercise state and may not be given exact motivation such as an exercise goal, making it difficult to expect improvement in the exercise effect.

SUMMARY

To measure a user's exercise state, adoption of a sensor module detecting weight setting, the number of times of an exercise, an exercise speed, etc., may be considered. In particular, to accurately measure the user's exercise state, a sensor module used in a weight exercise apparatus may require a high measurement frequency as well as a high measurement accuracy.

However, a sensor satisfying both the high measurement accuracy and the high measurement frequency is expensive, such that the sensor may be difficult to adopt in the weight exercise apparatus.

Provided are a sensor module capable of lowering a price burden while enabling accurate measurement to efficiently guide a user's weight exercise and a weight exercise apparatus including the sensor module.

Additional aspects will be set forth in part in the description which follows and, in part, will be apparent from the description, or may be learned by practice of the presented embodiments of the disclosure.

According to an aspect of the disclosure, a weight exercise apparatus includes an exercise main body including a plurality of weight plates, a sensor module configured to detect weight setting of the exercise main body and movement of the weight plate, a user interface (UI) unit configured to output a UI screen, a memory storing at least one instruction, and a processor configured to control the UI unit to display a UI element indicating an exercise state of a user corresponding to the detected movement on the UI screen, by executing the at least one instruction, in which the sensor module includes a first laser sensor including a first measurement accuracy and a first measurement frequency to detect weight setting of the exercise main body when the weight plate is in a stationary state and a second laser sensor including a second measurement accuracy lower than the first measurement accuracy and a second measurement frequency higher than the first measurement frequency to detect movement of the weight plate when the weight plate is in a moving state.

The first laser sensor may be arranged to detect a position of a pin structure for weight setting of the weight exercise apparatus.

The second laser sensor may be arranged to detect the position of the pin structure.

The second laser sensor may be arranged to detect a position that is different from a position measured by the first laser sensor.

The second laser sensor may be arranged to detect a position of a surface of the weight plate.

The first measurement frequency is about 4 times or less per second, and the second measurement frequency may be about 5 times to about 15 times per second.

The first measurement accuracy may have an error range of about 1 mm or less, and the second measurement accuracy may have an error range of about 15 mm or less.

The processor may be further configured to control the UI unit to display the UI element on the UI screen according to information detected by the second laser sensor based on whether a position of the weight plate moves, by executing the at least one instruction.

The first laser sensor may be arranged to irradiate a laser beam toward a reference surface, when the pin structure is arranged on the weight plate, the pin structure may be arranged between the reference surface and the first laser sensor and the laser beam irradiated from the first laser sensor may be irradiated to the pin structure without being irradiated to the reference surface, and when an $N^{th}$ measured distance measured by the first laser sensor is matched to a maximum distance that is a distance between the first laser sensor and the reference surface, and an $(N+1)^{th}$ measured distance measured thereafter by the first laser sensor is less than the maximum distance, the processor may be further configured to determine weight setting of the exercise main body based on the $(N+1)^{th}$ measured distance.

The processor may be further configured to, by executing the at least one instruction, when a difference between a preset zero point distance and a measured distance measured by the second laser sensor is greater than a reference distance, perform display to move a position of the UI element based on the difference, and when the difference between the zero point distance and the measured distance measured by the second laser sensor is less than or equal to the reference distance, perform display to maintain the position of the UI element.

According to another aspect of the disclosure, a sensor module to detect weight setting of a weight exercise apparatus including a plurality of weight plates and movement of the weight plate includes a first laser sensor including a first measurement accuracy and a first measurement frequency to detect weight setting of the weight exercise apparatus when the weight plate is in a stationary state and a second laser sensor including a second measurement accuracy lower than the first measurement accuracy and a second measurement frequency higher than the first measurement frequency to detect movement of the weight plate when the weight plate is in a moving state.

The first laser sensor may be arranged to detect a position of a pin structure for weight setting of the weight exercise apparatus.

The second laser sensor may be arranged to detect the position of the pin structure.

The second laser sensor may be arranged to detect a position that is different from a position measured by the first laser sensor.

The second laser sensor may be arranged to detect a position of a surface of the weight plate.

The first measurement frequency may be about once to about 10 times per second, and the second measurement frequency may be about 5 times to about 200 times per second.

The first measurement accuracy may have an error range of about 5 mm or less, the second measurement accuracy may have an error range of about 15 mm or less.

According to another aspect of the disclosure, a weight exercise apparatus includes an exercise main body including a plurality of weight plates, a sensor module configured to detect weight setting of the exercise main body and movement of the weight plate, a user interface (UI) unit configured to output a UI screen, a memory storing at least one instruction, and a processor configured to control the UI unit to display a UI element indicating an exercise state of a user corresponding to the detected movement on the UI screen, by executing the at least one instruction, in which the sensor module includes a first sensing mode including a first measurement accuracy and a first measurement frequency to detect weight setting of the exercise main body when the weight plate is in a stationary state and a second sensing mode including a second measurement accuracy lower than the first measurement accuracy and a second measurement frequency higher than the first measurement frequency to detect movement of the weight plate when the weight plate is in a moving state.

The sensor module may be arranged to detect a position of a pin structure for weight setting of the weight exercise apparatus.

Other aspects, features, advantages, and advantages other than those described above will become apparent from the following figures, claims, and the detailed description of the disclosure.

These general and specific aspects may be carried out using a system, a method, a computer program, or any combination of thereof.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
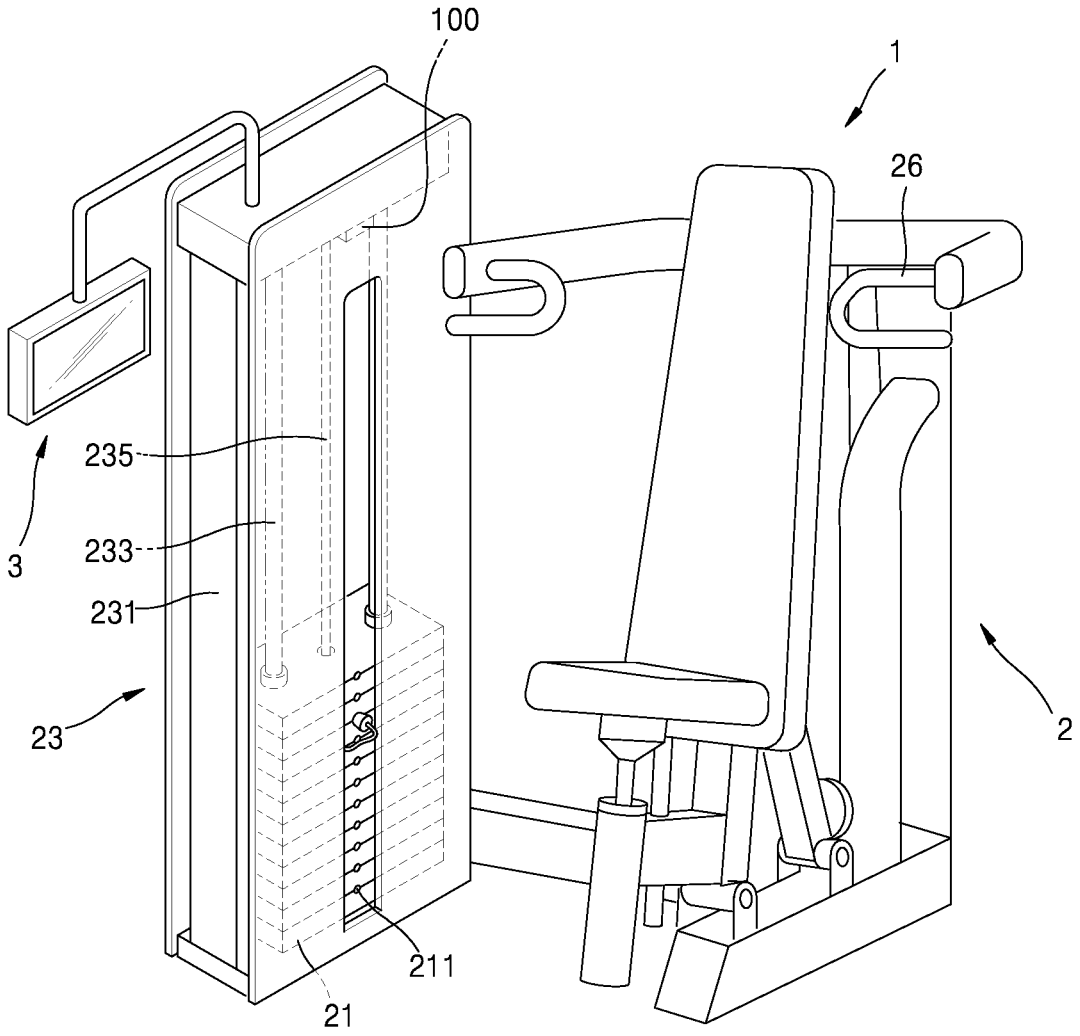
FIG. 1 is a perspective view for describing a weight exercise apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

Hereinafter, various embodiments will be described in detail with reference to the drawings. Embodiments described below may be changed into various different forms and performed. To more clearly describe characteristics of the embodiments, a detailed description of matters widely known to those of ordinary skill in the art to which the following embodiments belong will be omitted.

Meanwhile, throughout the specification, when any component is "connected" to another component, it may include not only a case where they are 'directly connected', but also a case where they are 'electrically connected with another component therebetween'. When a component "includes" another component, it may mean that the component may further include other components rather than excluding the other component, unless stated otherwise.

In addition, terminology, such as 'first' or 'second' used herein, can be used to describe various components, but the components should not be limited by the terms. These terms are used to distinguish one component from another component.

The term used herein such as 'unit', 'module', etc., indicates a unit for processing at least one function or operation, and may be implemented in hardware, software, or in a combination of hardware and software.

Current embodiments relate to a weight exercise apparatus and a sensor module used therefor, and matters widely known to those of ordinary skill in the art to which the following embodiments belong will not be described in detail.

Figure 2:
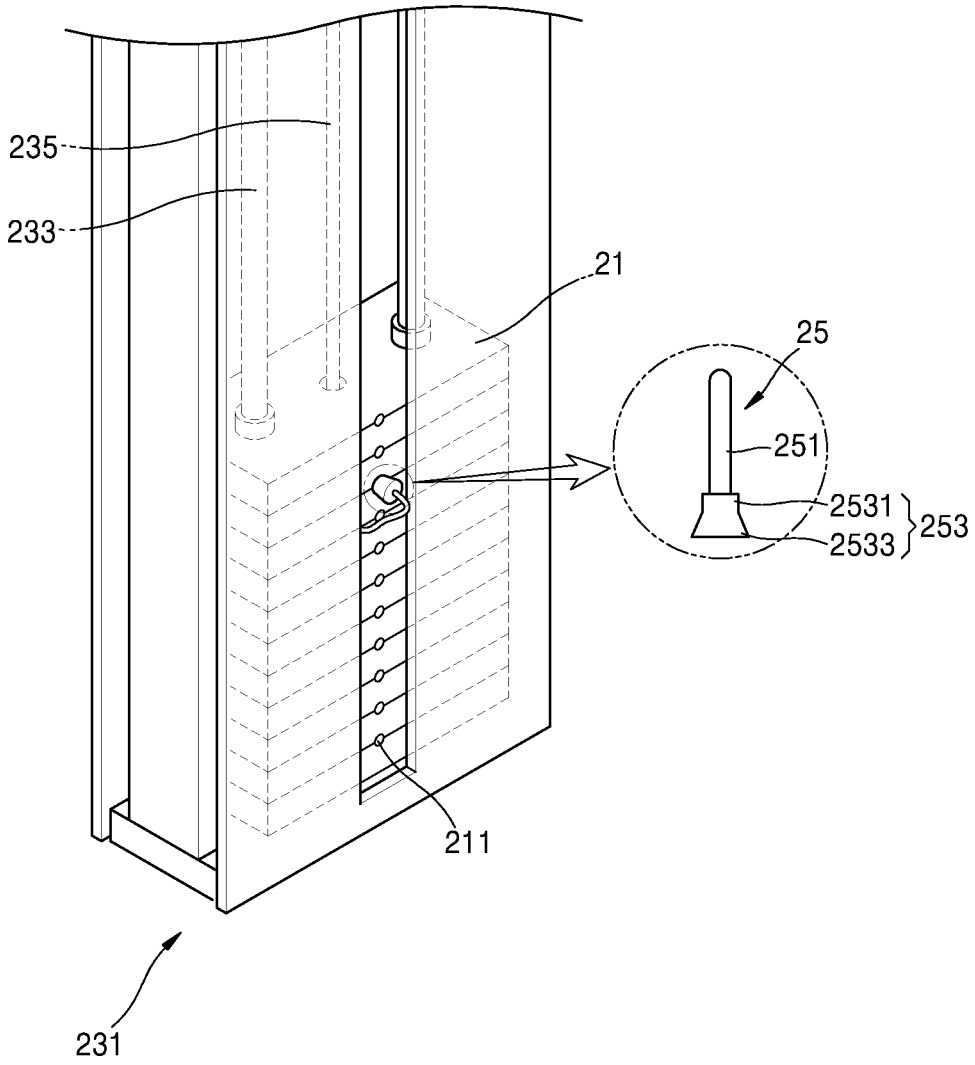
FIG. 2 is a view for describing a structure for setting a weight of a weight exercise apparatus according to an embodiment.
Figure 3:
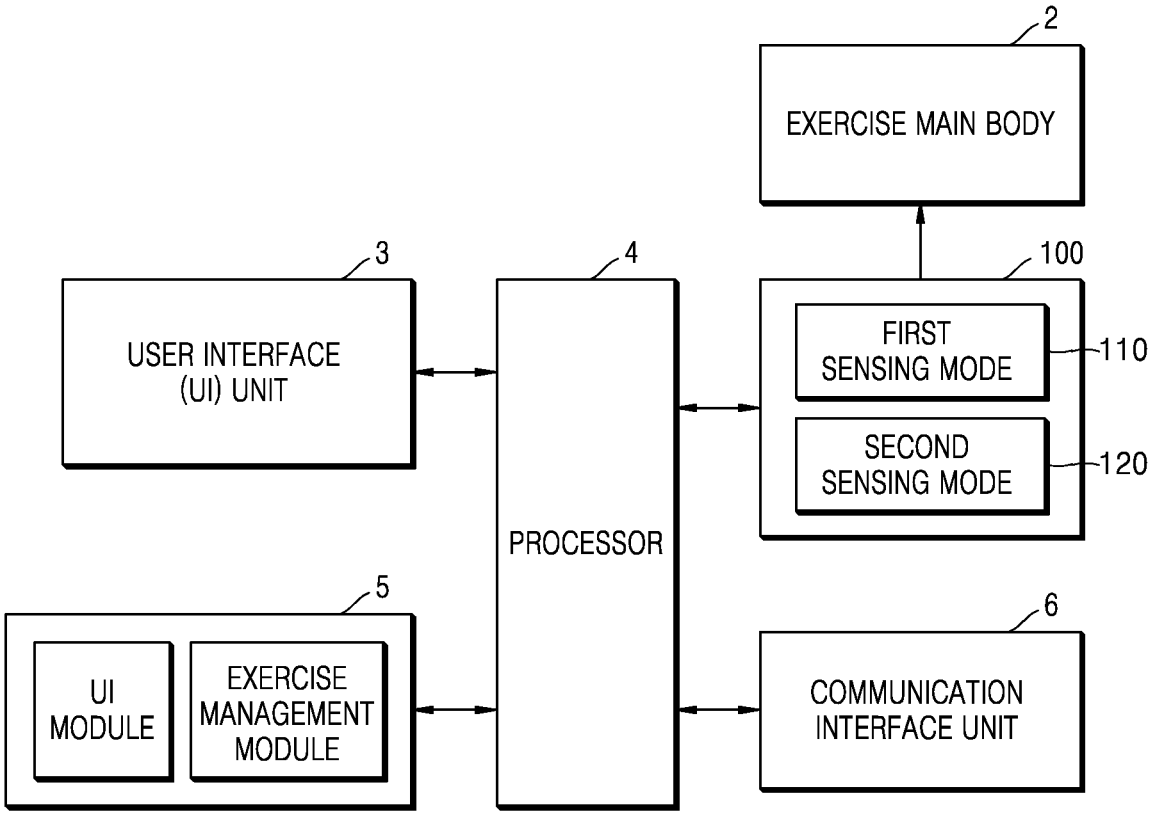
FIG. 3 is a block diagram of a weight exercise apparatus according to an embodiment.
Figure 4:
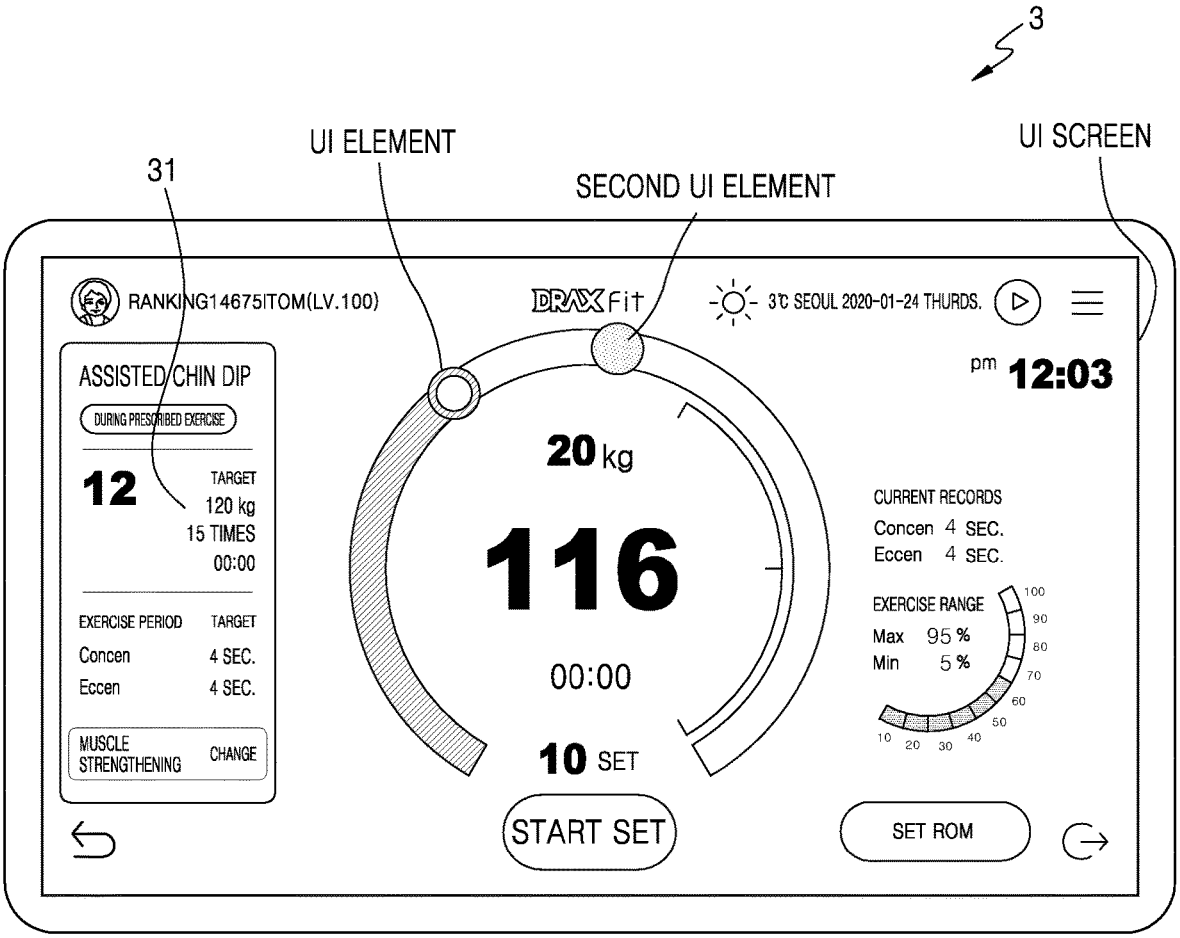
FIG. 4 shows a user interface (UI) screen output on a UI unit of a weight exercise apparatus according to an embodiment.

FIG. 1 is a perspective view for describing a weight exercise apparatus 1 according to an embodiment, and FIG. 2 is a view for describing a structure for setting a weight of the weight exercise apparatus 1 according to an embodiment. FIG. 3 is a block diagram of the weight exercise apparatus 1 according to an embodiment. FIG. 4 shows a UI screen output on the UI unit 3 of the weight exercise apparatus 1 according to an embodiment.

Referring to FIGS. 1 to 3, the weight exercise apparatus 1 may include an exercise main body 2, a sensor module 100, a user interface (UI) unit 3, and a processor 4.

The exercise main body 2 may be exercise equipment that generates movement according to a user's weight exercise. For example, the exercise main body 2 may include a plurality of weight plates 21 and a frame structure 23 that supports the plurality of weight plates 21 to allow the plurality of weight plates 21 to move in a gravity direction and a direction opposite thereto, e.g., up and down.

Referring to FIG. 2, the exercise main body 2 may include a pin structure 25 for selecting at least some of the plurality of weight plates 21. The pin structure 25 may be inserted into a pin hole 211 to select the weight plate 21 corresponding to a weight desired by a user. The pin hole 211 may be formed by the adjacent weight plate 21. However, arrangement of the pin hole 211 may not be limited thereto and may be various. For example, the pin hole 211 may be formed in each weight plate 21.

The pin structure 25 may include an insertion region 251 to be inserted into the pin hole 211 and a holder region 253 fixed to the insertion region 251. The insertion region 251 of the pin structure 25 may have a shape corresponding to the shape of the pin hole 211. The holder region 253 may include a cylindrical portion 2531 having a constant diameter in an extending direction of the pin structure 25 and a slope portion 2533 extending from the cylindrical portion 2531 and having a diameter changing in an extending direction thereof. However, the shape of the holder region 253 may not be limited thereto and may be changed into various shapes as long as they allow the user to insert the pin structure 25 into the pin hole 211 or remove the pin structure 25 from the pin hole 211.

As the insertion region 251 of the pin structure 25 is inserted into the pin hole 211 of the certain weight plate 21, a weight of the certain weight plate 21 into which the pin structure 25 is inserted and a weight of the weight plate 21 arranged on the certain weight plate 21 may be selected.

The plurality of weight plates 21 may be sequentially stacked in a vertical direction. Each of the plurality of weight plates 21 may have a weight. Weights of the plurality of weight plates 21 may be respectively equal to or different from one another. For example, the weights of the plurality of weight plates 21 may be respectively equal to about 5 kg. In another example, some of the plurality of weight plates 21 may have a weight of about 5 kg, respectively, and the others of the plurality of weight plates 21 may have a weight of about 10 kg, respectively. In addition, the weights of the plurality of weight plates 21 may be various.

The frame structure 23 may include a base frame 231 and a pair of guide rails 233 that extend in the vertical direction to allow the plurality of weight plates 21 to move up and down and are installed on the base frame 231. The pair of guide rails 233 may be arranged to penetrate the plurality of weight plates 21. The frame structure 23 may include a connection line 235 configured to deliver a force applied by the user to the weight plate 21.

In the weight exercise apparatus 1 according to an embodiment, the user may apply a force to an exercise structure 26 to move the weight plate 21 corresponding to the selected weight in a direction opposite to the gravity direction or in the gravity direction. The exercise structure 26 may be implemented in various forms depending on a body part for which the user is to exercise. The form of the exercise structure 26 is widely known and thus will not be described in detail.

The weight exercise apparatus 1 according to an embodiment may further include a component to measure the user's exercise state and feed a result back in the exercise main body 2. For example, the weight exercise apparatus 1 may include a sensor module 100, a UI unit 3 outputting a UI screen, a memory 5 storing at least one instruction, and a processor 4 controlling the UI unit 3.

The UI unit 3 may include an input unit for receiving an input to operate the exercise equipment, an input to set the exercise apparatus, etc., from the user and an output unit for displaying information such as an exercise state, an exercise result, etc. For example, the UI unit 3 may have, but not limited to, a form of a touch screen.

The processor 4 may manage information for managing various functions provided by the weight exercise apparatus 1 or the user's exercise state, by executing at least one instruction stored in the memory 5. The exercise state of the user may include the number of times or a duration the user exercises, an exercise level, an exercise speed, a trajectory of a body of the user, etc. The processor 4 may include at least one processing modules. For example, the processor 4 may include at least one of a central processing unit (CPU), a microprocessor, a graphical processing unit (GPU), application specific integrated circuits (ASICs), a digital signal processor (DSP), and field programmable gate arrays (FPGAs). The processor 4 may control the other components included in the weight exercise apparatus 1 to perform a function corresponding to a user input received through the UI unit 3. The processor 4 may execute instructions, a software module, or a program stored in the memory 5, read data or a file stored in the memory 5, or store a new program or application in the memory 5.

The memory 5 may store at least one instruction. The processor 4 may correspond to an example of a computer capable of executing instructions stored in the memory 5. The memory 5 may store instructions, a software module, or a program. The memory 5 may include at least one of a random access memory (RAM), a static random access memory (SRAM), a read-only memory (ROM), a flash memory, an electrically erasable programmable read-only memory (EEPROM), a programmable read-only memory (PROM), a magnetic memory, a magnetic disk, and an optical disk.

The memory 5 may store a UI module and an exercise management module therein. The UI module and the exercise management module may be software modules or programs including at least one instruction and may correspond to a part of another program. The processor 4 may load the UI module and the exercise management module from the memory 5 and execute corresponding instructions.

The UI module may include an UI input/output module and an UI configuration module. The UI input/output module may identify a user's input with respect to a UI screen displayed on the UI unit 3, and control an output of a UI element generated or changed in the UI configuration module. The UI configuration module may generate or change a UI element to be displayed on the UI unit 3 based on information identified by the exercise management module, the UI unit 3, the sensor module 110, etc.

The exercise management module may include an exercise process setting module and an exercise state identification module. The exercise process setting module may set an exercise process suitable for the user based on information about the user when the user who is to use the weight exercise apparatus 1 is identified. For example, the exercise process setting module may receive exercise process information from a smart gym server 200 through a communication interface unit 6 and set an exercise process corresponding to the identified user. The exercise state identification module may generate the user's exercise state information and generate information indicating a progress of the exercise process reflecting the user's exercise state or information indicating the exercise result, based on movement of the exercise main body, received through the sensor module 100. The sensor module 100 of the exercise state identification module may deliver the generated information to the UI module or record the generated information in the memory 5.

The communication interface unit 6 may perform wired/wireless communication with another device or a network. To this end, the communication interface unit 6 may include a communication module supporting at least one of various wired/wireless communication methods. For example, communication modules that perform short-range communications such as Wireless Fidelity (Wi-Fi), various types of mobile communications such as 3rd-Generation (3G), 4th-Generation (4G), 5th-Generation (5G), etc., or ultra-wideband communications, or communications modules that perform wired communications using coaxial cables, optical cables, etc., may be included, and without being limited thereto, various types of communication modules according to the development of communication technology may be included. The communication interface unit 6 may be connected to a device located outside the weight exercise apparatus 1 to transmit and receive a message including a signal or data. The weight exercise apparatus 1 may communicate with the smart gym server 200, a user terminal in a form such as a wearable device, a smart phone, etc., or a manager terminal 300 (see FIG. 19) in a form such as a personal computer (PC), a laptop computer, a smart phone, etc., through the communication interface unit 6.

The sensor module 100 may include at least one sensor to detect weight setting of the exercise main body 2 and movement of the weight plate 21. The sensor module 100 may obtain sensing data corresponding to weight setting of the exercise main body 2. The sensor module 100 may sense movement of a manipulation unit the weight plate 21 of the weight exercise apparatus 1 or a user's body contacts, and obtain sensing data corresponding to the sensed movement. The sensing data may have a form of a time, a distance, a depth, an image, etc.

Referring to FIG. 4, based on the foregoing configuration, the processor 4 may control the UI unit 3 to display information 31 indicating weight setting of the exercise main body 2 detected by the sensor module 100 on the UI screen, by executing at least one instruction stored in the memory 5. The processor 4 may control the UI unit 3 to display a UI element indicating a user's exercise state corresponding to the movement of the weight exercise apparatus 1 detected by the sensor module 100 on the UI screen. The processor 4 may control the UI unit 3 to display a second UI element indicating an exercise guide recommended in an exercise using the weight exercise apparatus 1, together with the UI element, on the UI screen.

As such, the user of the weight exercise apparatus 1 may recognize a weight setting state and an exercise state by using data (or information) displayed on the UI screen. In this way, the user may exercise efficiently.

Figure 5:
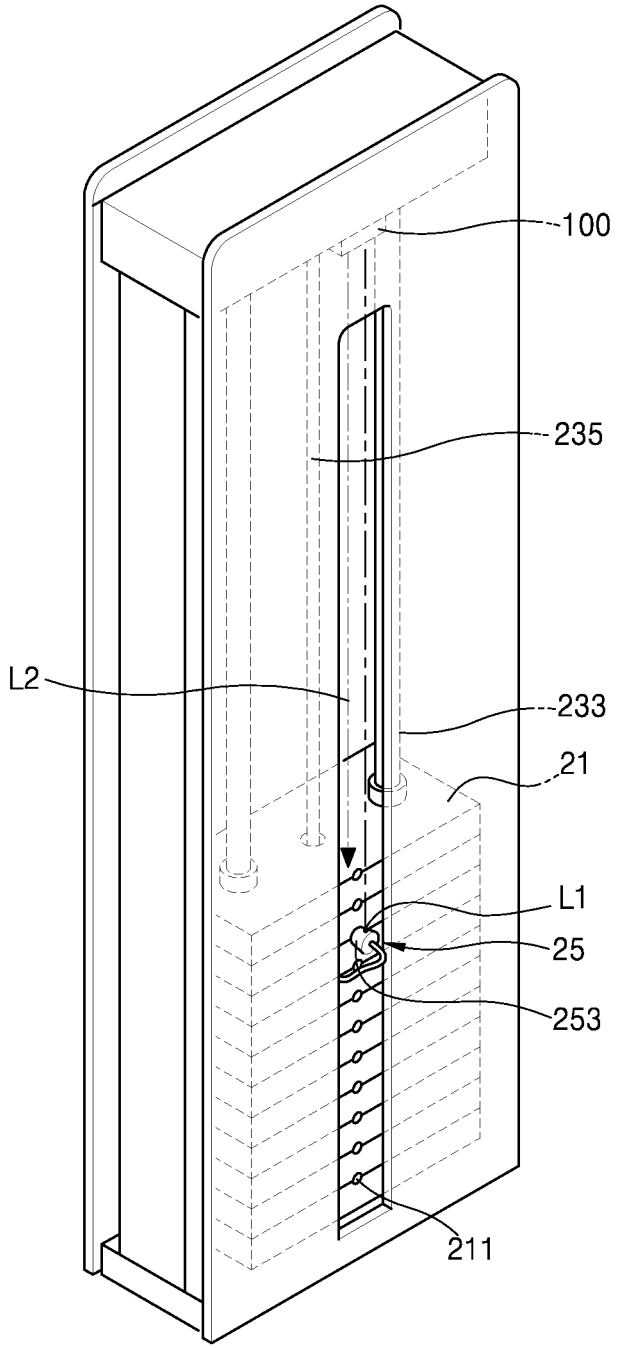
FIG. 5 is a view for describing an example of a sensor module of a weight exercise apparatus according to an embodiment.
Figure 6:
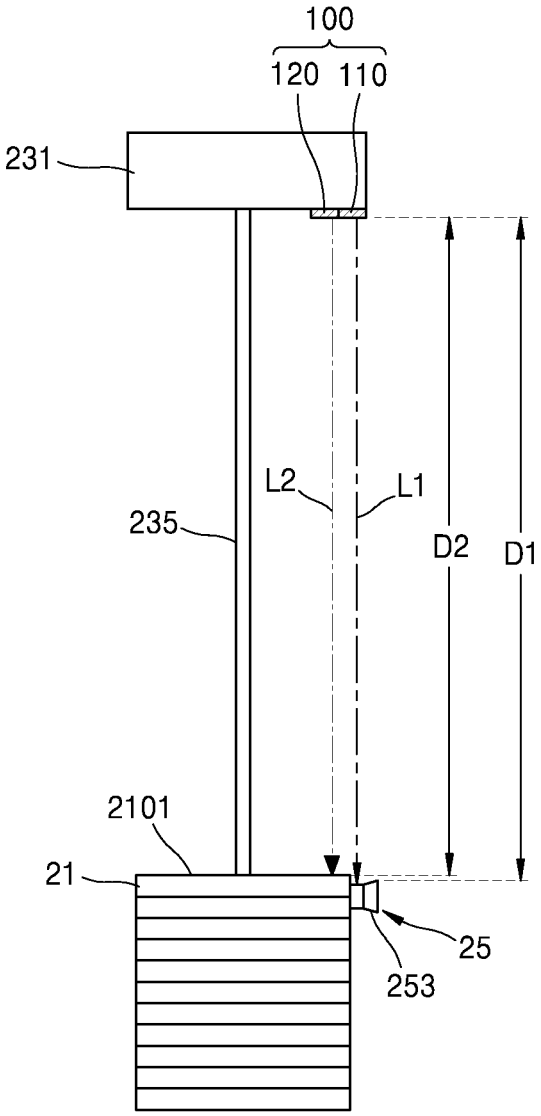
FIG. 6 is a view for describing a function of a sensor module according to an embodiment.

FIG. 5 is a view for describing an example of the sensor module 100 of the weight exercise apparatus 1 according to an embodiment. FIG. 6 is a view for describing a function of the sensor module 100 according to an embodiment.

Referring to FIGS. 5 and 6, the sensor module 100 may detect weight setting of the exercise main body 2 and movement of the weight plate 21. The sensor module 100 may perform a function of detecting a position into which the pin structure 25 is inserted when the user selects the desired weight plate 21 for exercise setting, and perform a function of detecting positional movement of the pin structure 25 to monitor the user's exercise state during the exercise of the user.

The ideal sensor module 100 may not only detect the accurate position of the pin structure 25, but also track movement of the pin structure 25 in real time, with one laser sensor. To this end, the sensor module 100 may need to have a high measurement frequency as well as a high precision. However, the sensor module 100 having a high precision and a high measurement frequency is expensive, and thus is not suitable for use in the weight exercise apparatus 1.

An embodiment may provide a structure capable of tracking the positional movement of the pin structure 25 without distortion as much as possible during the user's exercise while detecting the accurate position of the pin structure 25 during the user's weight setting, by using a relatively low-price laser sensor.

The sensor module 100 according to an embodiment may include a first laser sensor 110 and a second laser sensor 120.

When the weight plate 21 is in a stationary state, the first laser sensor 110 may be configured to detect weight setting of the exercise main body 2. For example, the first laser sensor 110 may be configured to detect a position of the weight plate 21 when the weight plate 21 is in the stationary state. For example, the first laser sensor 110 may have a first measurement accuracy and a high measurement frequency. For example, the first measurement accuracy may have an error range of about 5 mm or less. For example, the first measurement accuracy may have an error range of about 1 mm or less. The first measurement frequency may be once per second and may be less than or equal to 10 times. For example, the first measurement frequency may be less than or equal to 4 times per second.

When the weight plate 21 is in a moving state, the second laser sensor 120 may be configured to detect movement of the weight plate 21. The second laser sensor 120 may be configured to detect a position of the weight plate 21 when the weight plate 21 is in the moving state. For example, the second laser sensor 120 may have a second measurement accuracy and a second measurement frequency.

The second measurement accuracy may be lower than the first measurement accuracy. For example, when the first measurement accuracy has an error range of about 1 mm or less, the second measurement accuracy may have an error range of about 15 mm or less. The error range of the second measurement accuracy may be greater than that of the first measurement accuracy.

The second measurement frequency may be higher than the first measurement frequency. For example, the first measurement frequency may be about once to about 10 times per second, and the second measurement frequency may be about 5 times to about 200 times per second. When the first measurement frequency is less than or equal to about 4 times per second, the second measurement frequency may be equal to or more than about 5 times and less than or equal to about 15 times per second. However, the first and second measurement frequencies may not be limited thereto and may be various. For example, the second measurement frequency may be less than or equal to about 100 times or less than or equal to about 500 times.

In the weight exercise apparatus 1 according to an embodiment, the first laser sensor 110 has a relatively high measurement accuracy to detect accurate weight setting of the weight exercise apparatus 1, and the second laser sensor 120 has a relatively high measurement frequency to quickly detect the user's exercise state without a delay in the weight exercise apparatus 1.

The first laser sensor 110 may be configured to detect the position of the pin structure 25 for weight setting of the weight exercise apparatus 1. For example, the first laser sensor 110 may be arranged to irradiate a laser beam L1 to a holder region 253 of the pin structure 25. For example, the first laser sensor 110 may be arranged to overlap the holder region 253 in the gravity direction.

The second laser sensor 120 may be arranged to detect a position that is different from a position measured by the first laser sensor 110. For example, the first laser sensor 110 is configured to detect a position of the pin structure 25, and the second laser sensor 120 may be configured to detect a position of the weight plate 21 of the weight exercise apparatus 1. For example, the second laser sensor 120 may be arranged to detect movement of the topmost weight plate 21 among the plurality of weight plates 21. The second laser sensor 120 may be arranged to irradiate a laser beam L2 to a top surface 2101 of the topmost weight plate 21.

However, arrangement of the second laser sensor 120 may not be limited thereto, and may be changed variously as long as it is intended to directly or indirectly detect a state of moving the weight plate 21 by the user. For example, the second laser sensor 120 may be arranged to irradiate the laser beam L2 to the holder region 253 of the pin structure 25. For example, the second laser sensor 120 may be arranged adjacent to the first laser sensor 110 to overlap the holder region 253.

The processor 4 may process data detected by the first laser sensor 110 and the second laser sensor 120.

Figure 7:
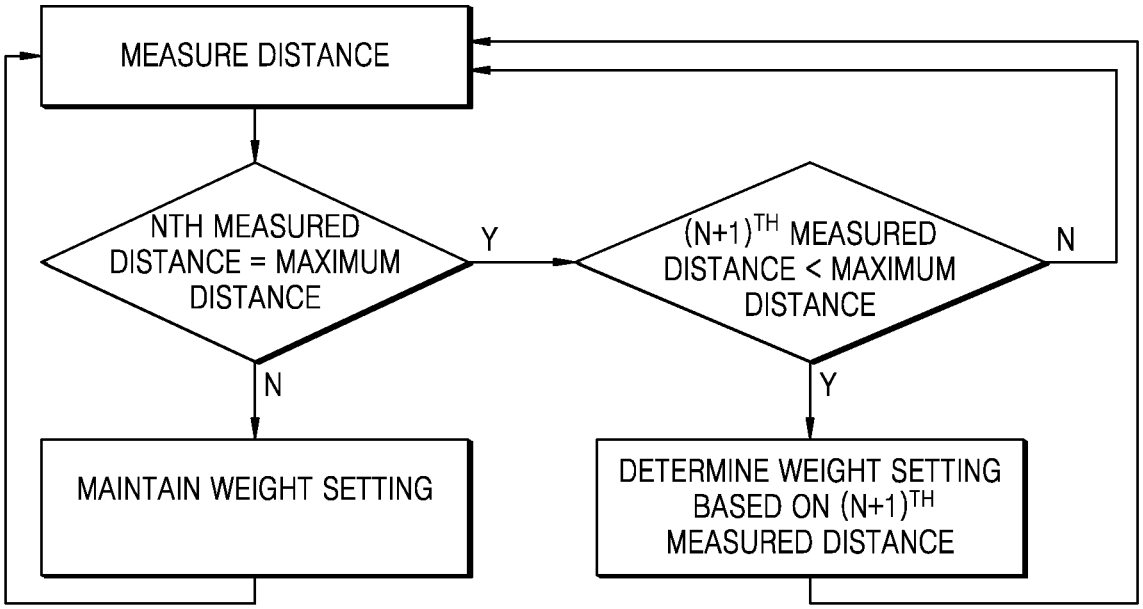
FIG. 7 is a flowchart of a process, performed by a first laser sensor, of determining weight setting of a weight exercise apparatus according to an embodiment.
Figure 8:
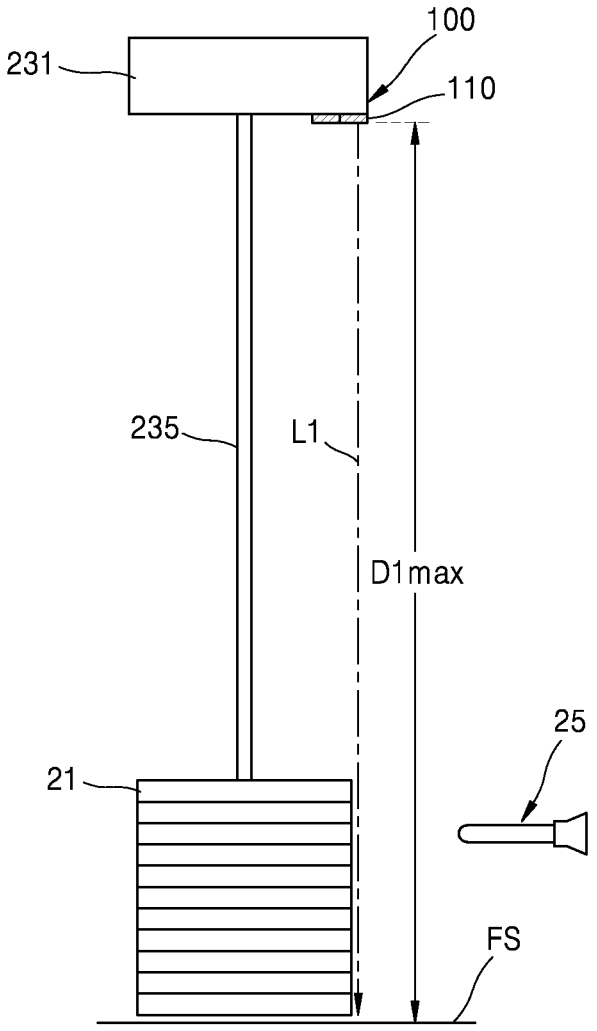
FIGS. 8 and 9 are views for describing an operation of a first laser sensor according to an embodiment.
Figure 9:
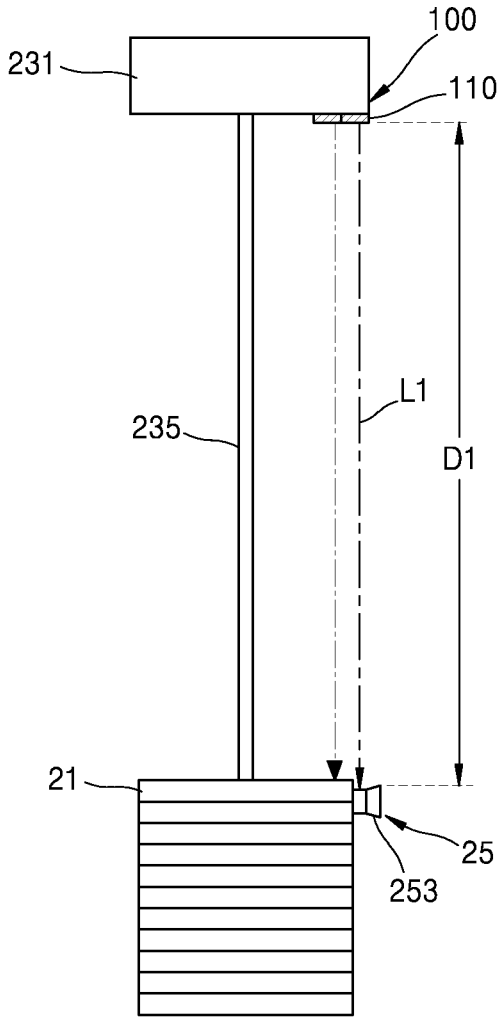

FIG. 7 is a flowchart of a process, performed by the first laser sensor 110 according to an embodiment, of determining weight setting of the weight exercise apparatus 1, and FIGS. 8 and 9 are views for describing an operation of the first laser sensor 110 according to an embodiment.

Referring to FIGS. 7 to 9, the first laser sensor 110 may irradiate the first laser beam L1 a plurality of times. The first laser sensor 110 may receive the reflected first laser beam L1 to measure a distance to a measurement target. The processor 4 may determine weight setting of the weight exercise apparatus 1 based on the data detected by the first laser sensor 110. For example, the processor 4 may determine weight setting in consideration of a maximum distance D1max measurable by the first laser sensor 110 arranged in a certain position on the weight exercise apparatus 1.

The maximum distance D1max measurable by the first laser sensor 110 may be a distance when the laser beam L1 irradiated by the first laser sensor 110 is not irradiated to the pin structure 25. For example, as shown in FIG. 8, the maximum distance D1max measurable by the first laser sensor 110 may be a distance D1 when the laser beam L1 is irradiated to a reference surface FS. When an $N^{th}$ measured distance D1 detected by the first laser sensor 110 is matched to the maximum distance D1max, and an $(N+1)^{th}$ measured distance D1 detected thereafter is less than the maximum distance D1max, the processor 4 may determine weight setting of the weight exercise apparatus 1 based on the detected $(N+1)^{th}$ measured distance D1. Herein, N may be an integer.

The first laser sensor 110 may be arranged to irradiate the laser beam L1 to the holder region 253 of the pin structure 25. Thus, as shown in FIG. 8, when the user separates the pin structure 25 to adjust weight setting, the first laser beam L1 may be temporarily irradiated to the reference surface FS, such that the measured distance D1 detected by the first laser sensor 110 may be instantly increased and matched to the maximum distance D1max. While the reference surface FS is described as a bottom surface in an embodiment, the disclosure is not limited thereto, and may be applied variously as long as it is a certain surface measured when the pin structure 25 is separated. Thereafter, as shown in FIG. 9, when the user inserts the pin structure 25 for weight setting, the measured distance D1 detected by the first laser sensor 110 may be less than the maximum distance D1max. The processor 4 may determine weight setting of the weight exercise apparatus 1 based on the measured distance D1 detected in an inserted state of the pin structure 25.

When the $N^{th}$ measured distance D1 detected by the first laser sensor 110 is matched to the maximum distance D1max, and the $(N+1)^{th}$ measured distance D1 detected thereafter is less than the maximum distance D1max, the processor 4 may determine weight setting based on the detected $(N+1)^{th}$ measured distance D1. The processor 4 may perform display on the UI screen according to the determined weight setting.

Thereafter, the processor 4 may continuously measure a distance through the first laser sensor 110. When the measured distance D1 measured thereafter is less than the maximum distance D1max, current weight setting may be maintained. The distance D1 detected by the first laser sensor 110 is less than the maximum distance D1max even when the pin structure 25 moves in the vertical direction during an exercise of the user, such that the current weight setting may be maintained. Thus, the current weight setting may be maintained until the user or another user separates the pin structure 25 to adjust weight setting.

Figure 10:
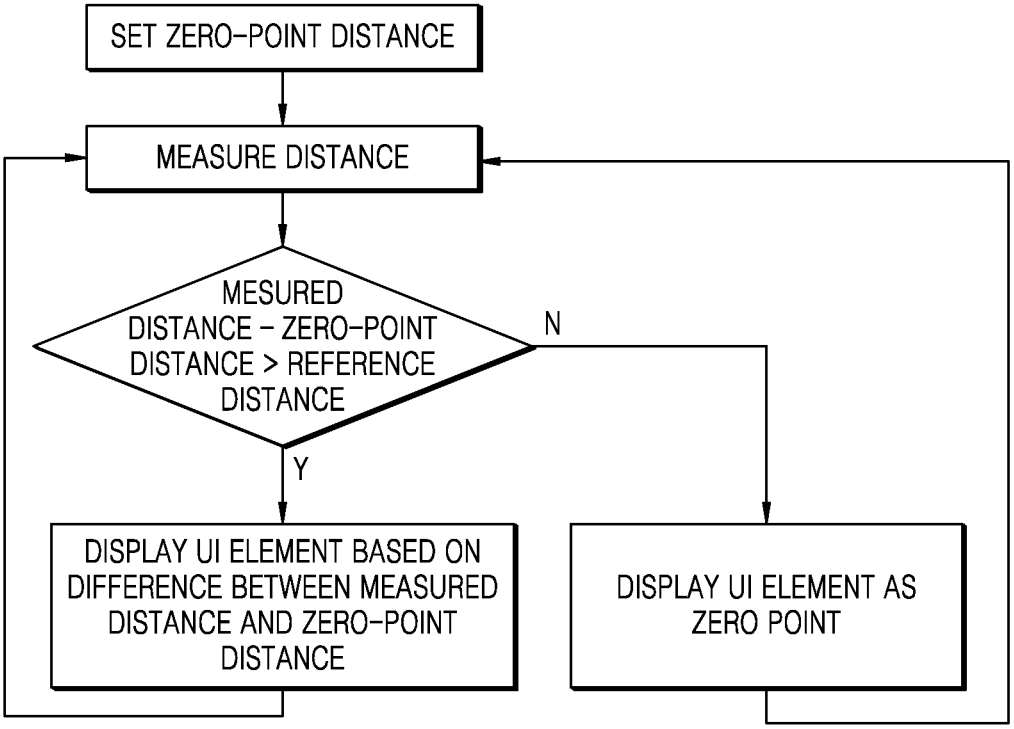
FIG. 10 is a flowchart of a process of determining a user's exercise state based on information detected by a second laser sensor, according to an embodiment.
Figure 11A:
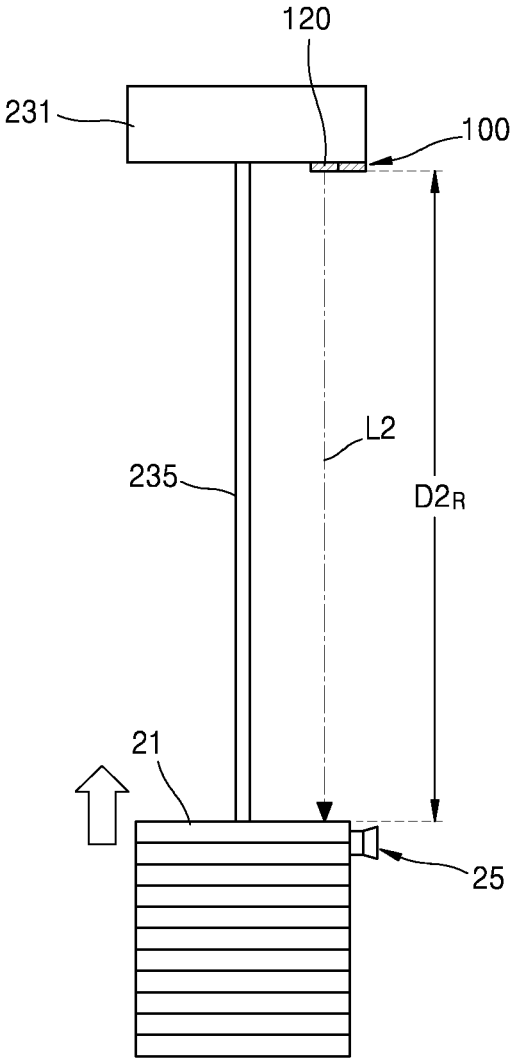
FIGS. 11A, 11B, and 11C are views for describing an operation of a second laser sensor according to an embodiment.
Figure 11B:
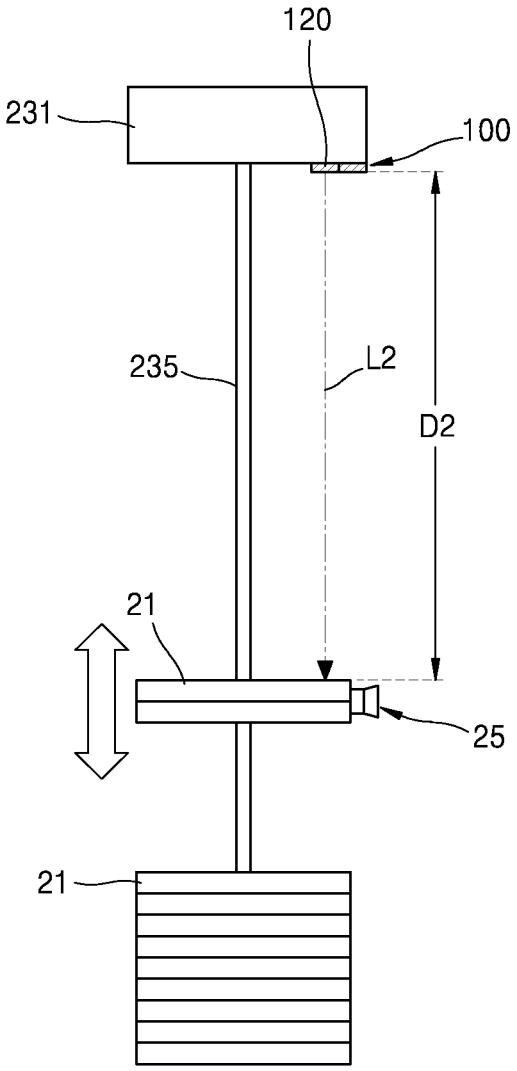
Figure 11C:
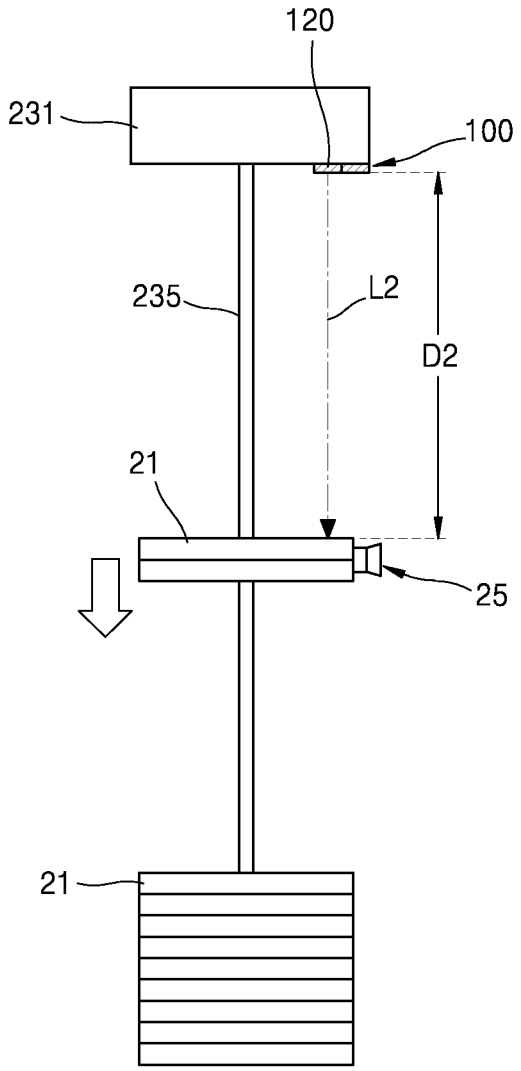
Figure 12:
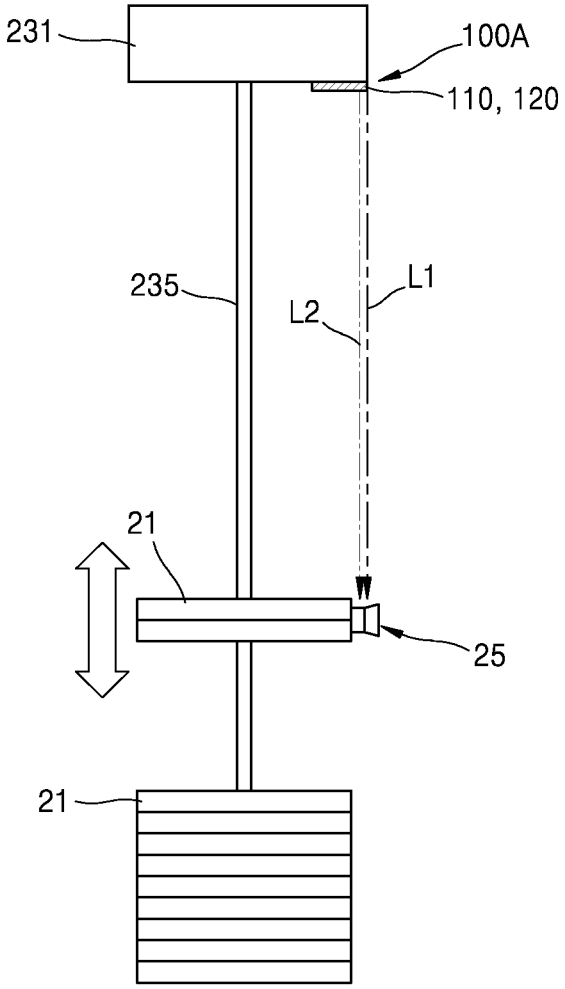
FIG. 12 is a view for describing arrangement of a second laser sensor according to another embodiment.

FIG. 10 is a flowchart of a process of determining a user's exercise state based on information detected by the second laser sensor 120 according to an embodiment, FIGS. 11A to 11C are views for describing an operation of the second laser sensor 120 according to an embodiment, and FIG. 12 is a view for describing arrangement of the second laser sensor 120 according to another embodiment.

Referring to FIGS. 10 and 11A to 11C, the processor 4 may control the UI unit 3 to display a UI element on the UI screen based on a distance measured by the second laser sensor 120.

The processor 4 may set the distance measured by the second laser sensor 120 before start of the exercise of the user to a zero-point distance $D2_R$.

Next, the processor 4 may determine whether a difference between a measured distance D2 and the zero-point distance $D2_R$ is greater than a reference distance. The reference distance may be greater than a measurement error of the second laser sensor 120. Thus, even when the measurement error of the second laser sensor 120 occurs, the UI element may be prevented from moving unintentionally.

The processor 4 may display the UI element as a zero point when the difference between the measured distance D2 and the zero-point distance $D2_R$ is not greater than the reference distance. In this way, in a state before the user starts an exercise, the UI element maintains a position without moving.

The processor 4 may display the UI element based on the difference when the difference between the measured distance D2 and the zero-point distance $D2_R$ is greater than the reference distance.

As the frequency of measurement by the second laser sensor 120 is relatively high, display of the UI element changes rapidly. Thus, movement of the UI element may be smooth.

In the above-described embodiment, an example is described where the second laser sensor 120 is arranged to detect the position of the surface of the weight plate 21, but arrangement of the second laser sensor 120 is not limited thereto and may be various as long as it is intended to detect the position of the weight plate 21. For example, as shown in FIG. 12, the second laser sensor 120 may be arranged to detect the position of the pin structure 25 together with the first laser sensor 110 of the sensor module 100A.

Meanwhile, in a weight exercise apparatus according to the above-described embodiment, an example is described where the sensor module 100 includes a plurality of laser sensors, but the sensor module 100 may include one laser sensor 101 having a plurality of sensing modes, without being limited to the example.

Figure 13:
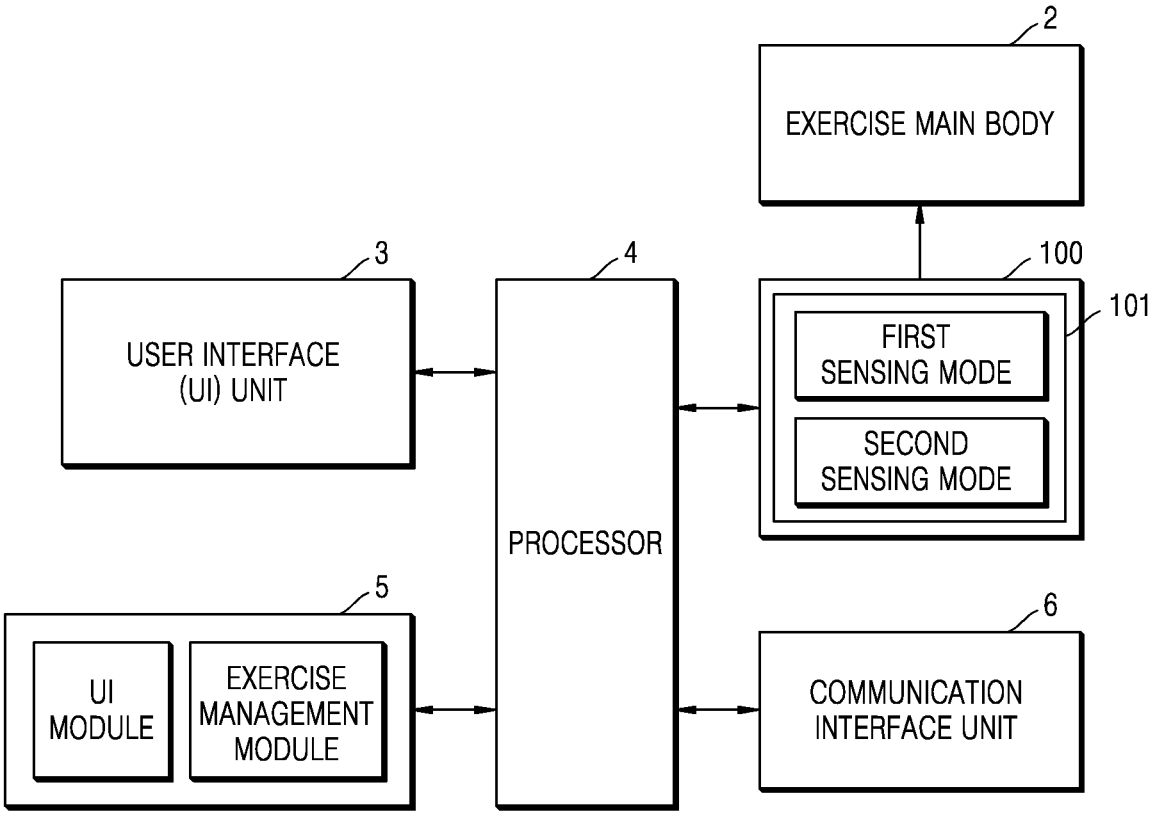
FIG. 13 is a block diagram of a weight exercise apparatus according to another embodiment.
Figure 14:
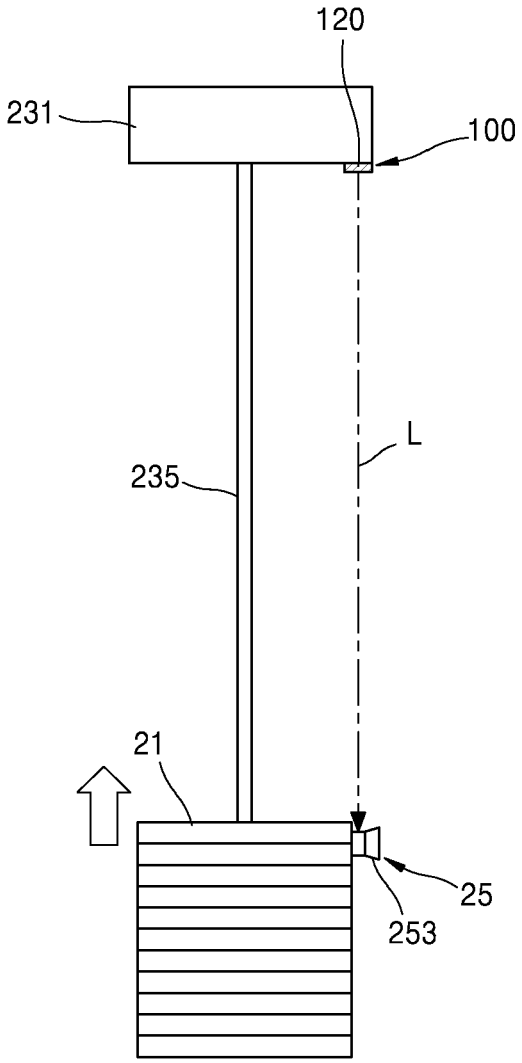
FIG. 14 is a view for describing an example of a sensor module of a weight exercise apparatus according to an embodiment.
Figure 15:
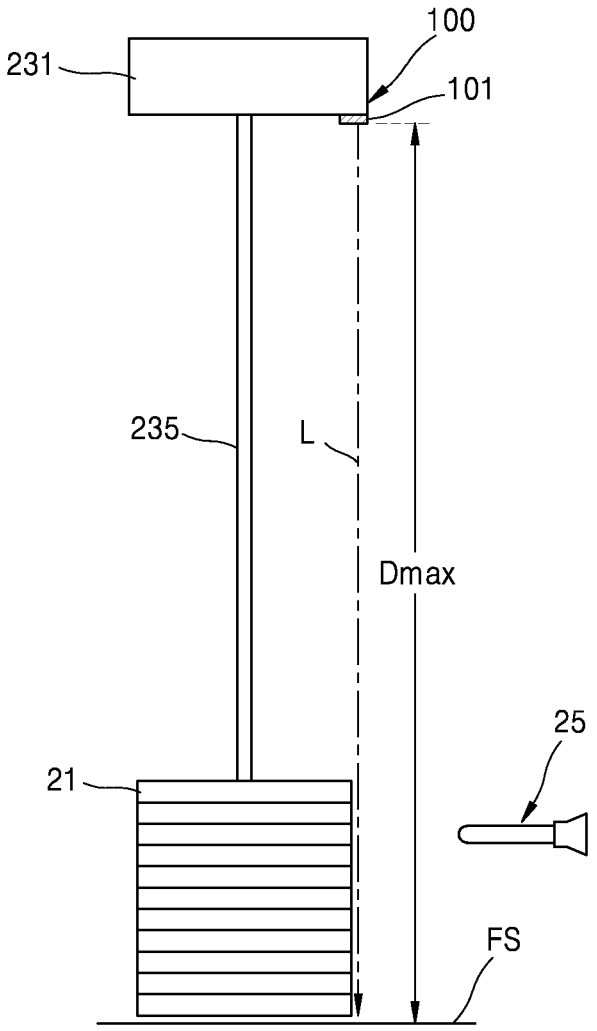
FIGS. 15 and 16 are views for describing an operation of a sensor module of a weight exercise apparatus according to the embodiment of FIG. 14 when the sensor module is in a first sensing mode.
Figure 16:
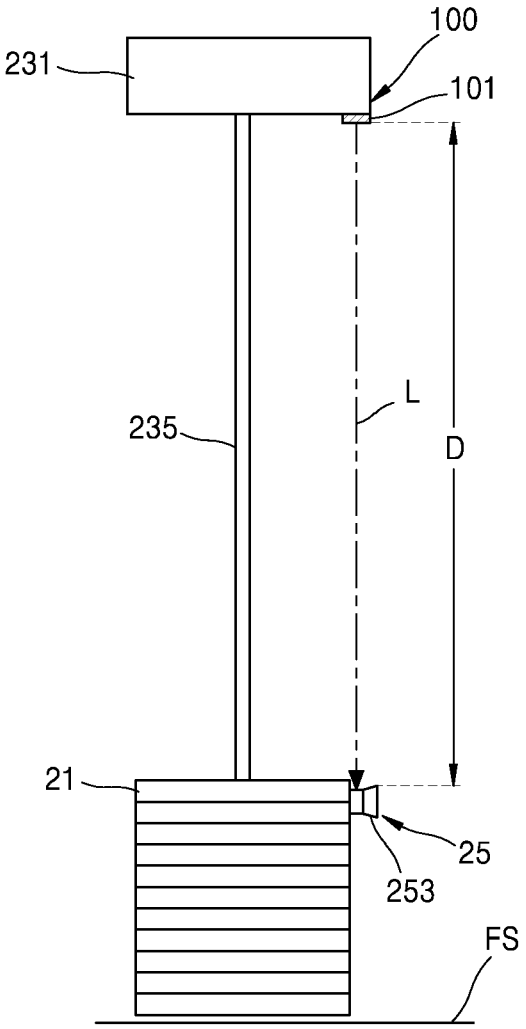
Figure 17:
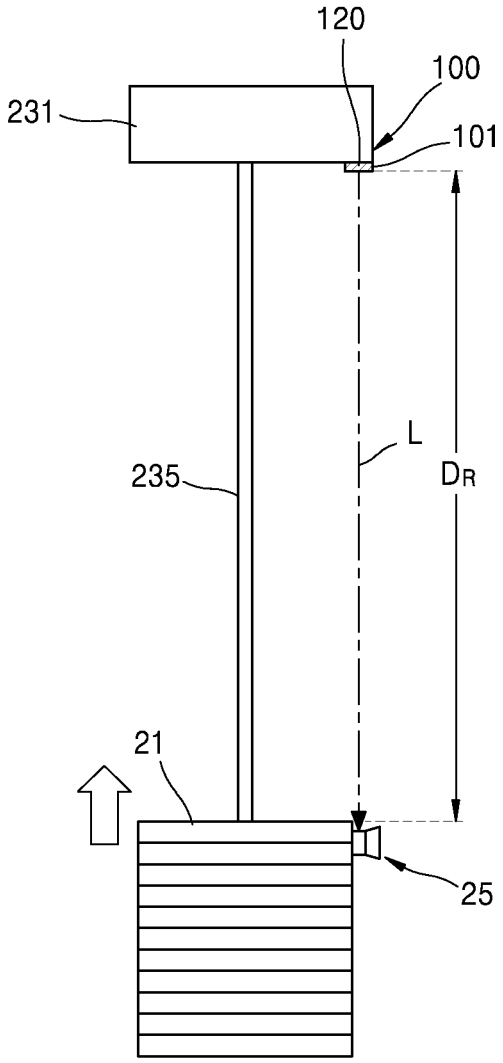
FIGS. 17 and 18 are views for describing an operation of a sensor module of a weight exercise apparatus according to the embodiment of FIG. 14 when the sensor module is in a second sensing mode.
Figure 18:
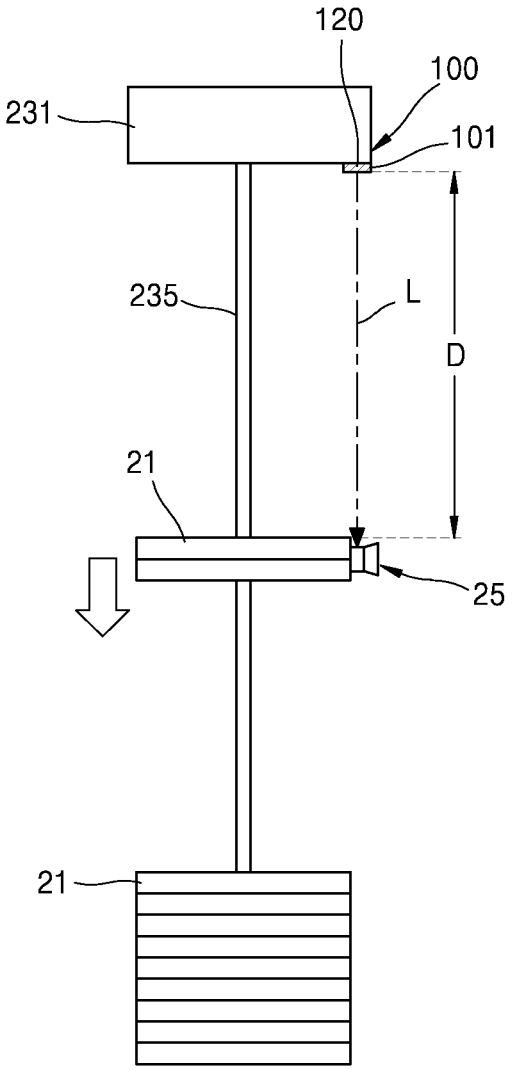

FIG. 13 is a block diagram of a weight exercise apparatus according to another embodiment. FIG. 14 is a view for describing an example of a sensor module of a weight exercise apparatus according to an embodiment. FIGS. 15 and 16 are views for describing an operation of a sensor module of a weight exercise apparatus according to the embodiment of FIG. 14 when the sensor module is in a first sensing mode. FIGS. 17 and 18 are views for describing an operation of a sensor module of a weight exercise apparatus according to the embodiment of FIG. 14 when the sensor module is in a second sensing mode.

Referring to FIGS. 13 and 14, the weight exercise apparatus 1 according to another embodiment may include the exercise main body 2, the sensor module 100, the UI unit 3, and the processor 4. The same matter as the foregoing embodiment will not be described redundantly, and a difference therebetween will be mainly described.

The sensor module 100 of the weight exercise apparatus 1 according to an embodiment may include one laser sensor 101 that irradiates a laser beam toward a measurement target and receives the laser beam reflected from the measurement target, and may have the first sensing mode enabling accurate measurement and the second sensing mode enabling fast measurement.

For example, the first sensing mode may be such that weight setting of the exercise main body 2 is detected in the stationary state of the weight plate 21. The first sensing mode may have the first measurement accuracy and the first measurement frequency.

For example, the first measurement accuracy may have an error range of about 5 mm or less. For example, the first measurement accuracy may have an error range of about 1 mm or less. The first measurement frequency may be once per second and may be less than or equal to 10 times. For example, the first measurement frequency may be less than or equal to 4 times per second.

For example, the second sensing mode may be such that movement of the weight plate 21 is detected when the weight plate 21 is in the moving state. For example, the second sensing mode may have a second measurement accuracy and a second measurement frequency.

The second measurement accuracy may be lower than the first measurement accuracy. For example, when the first measurement accuracy has an error range of about 1 mm or less, the second measurement accuracy may have an error range of about 15 mm or less. The error range of the second measurement accuracy may be greater than that of the first measurement accuracy.

The second measurement frequency may be higher than the first measurement frequency. For example, the first measurement frequency may be about once to about 10 times per second, and the second measurement frequency may be about 5 times to about 200 times per second. When the first measurement frequency is less than or equal to about 4 times per second, the second measurement frequency may be equal to or more than about 5 times and less than or equal to about 15 times per second. However, the first and second measurement frequencies may not be limited thereto and may be various. For example, the second measurement frequency may be less than or equal to about 100 times or less than or equal to about 500 times.

In the weight exercise apparatus 1 according to an embodiment, in the first sensing mode, with a relatively high measurement accuracy, accurate weight setting of the weight exercise apparatus 1 may be detected, and in the second sensing mode, with a relatively high measurement frequency, the user's exercise state may be quickly detected without a delay in the weight exercise apparatus 1.

The sensor module 100 may be arranged to detect the position of the pin structure 25 for weight setting of the weight exercise apparatus 1. For example, the sensing module 100 may be arranged to irradiate the laser beam L to the holder region 253 of the pin structure 25. For example, the sensing module may be arranged to overlap the holder region 253 in the gravity direction.

The pin structure 25 may maintain the position thereof in weight setting of the weight exercise apparatus 1 and the move together with the weight plate 21 during the exercise of the user. Thus, by detecting the position of the pin structure 25, the sensor module 100 may execute the first and second sensing modes having a plurality of functions.

The processor 4 may process data detected by the sensor module 100. Data processing based on the processor 4 may be performed similarly with data processing detected by the sensor module 100 including the above-described first and second laser sensors.

For example, the processor 4 may determine weight setting of the weight exercise apparatus 1 based on the data detected in the first sensing mode of the sensor module 100. For example, the processor 4 may determine weight setting in consideration of a maximum distance Dmax measurable by the sensor module 100 arranged in a certain position on the weight exercise apparatus 1.

Referring to FIGS. 13, 15, and 16, the maximum distance Dmax measurable by the sensor module 100 may be a distance when the laser beam L irradiated by the sensor module 100 is not irradiated to the pin structure 25. For example, the maximum distance Dmax measurable by the sensor module 100 may be a distance D when the laser beam is irradiated to the bottom surface FS. When the distance D detected in the first sensing mode of the sensor module 100 is matched to the maximum distance Dmax and then the distance D detected thereafter is less than the maximum distance Dmax, the processor 4 may determine weight setting of the weight exercise apparatus 1 based on the distance D detected thereafter.

As an example for executing the first sensing mode, the sensor module 100 may be arranged to irradiate the laser beam L toward the holder region 253 of the pin structure 25. Thus, when the user separates the pin structure 25 to adjust weight setting, the laser beam L1 may be temporarily irradiated to the bottom surface FS, such that the distance D detected by the sensor module 100 may instantly increase and thus may be matched to the maximum distance Dmax.

While the bottom surface FS is described as an example in the current embodiment, the disclosure is not limited thereto, and may be applied variously as long as it is a certain reference surface measured when the pin structure 25 is separated. Thereafter, when the user inserts the pin structure 25 for weight setting, the distance D detected by the sensor module 100 may be less than the maximum distance Dmax. The processor 4 may determine weight setting of the weight exercise apparatus 1 based on the distance D detected in the inserted state of the pin structure 25.

When the distance D detected by the laser sensor 101 is matched to the maximum distance Dmax and then the distance D detected thereafter is less than the maximum distance Dmax, the processor 4 may determine weight setting based on the distance D detected thereafter. The processor 4 may display the determined weight setting on the UI screen.

Thereafter, the processor 4 may continuously measure a distance through the sensor module 100. When the distance D measured thereafter is less than the maximum distance Dmax, the current weight setting may be maintained. The distance D1 detected by the sensor module is less than the maximum distance Dmax even when the pin structure 25 moves in the vertical direction during the exercise of the user, such that the current weight setting may be maintained. Thus, the current weight setting may be maintained until the user or another user separates the pin structure 25 to adjust weight setting.

Referring to FIGS. 13, 17, and 18, the processor 4 may control the UI unit 3 to display a UI element on the UI screen based on data detected in the second sensing mode of the sensor module 100.

As an example for this end, the processor 4 may set a zero-point distance $D_R$. For example, the processor 4 may set, to the zero-point distance $D_R$, a distance measured in a state before start of the exercise of the user, e.g., in the first sensing mode of the sensor mode.

Next, the processor 4 may determine whether a difference between the measured distance D and the zero-point distance $D_R$ is greater than a reference distance. The reference distance may be greater than a measurement error of the sensor module 100. Thus, even when the measurement error of the sensor module 100 occurs, the UI element may be prevented from moving unintentionally.

The processor 4 may display the UI element as a zero point when the difference between the measured distance D and the zero-point distance $D_R$ is not greater than the reference distance. In this way, in a state before the user starts an exercise, the UI element maintains a position without moving.

The processor 4 may display the UI element based on the difference when the difference between the measured distance D and the zero-point distance $D_R$ is greater than the reference distance.

As the frequency of measurement by the sensor module 100 in the second sensing mode is relatively high, display of the UI element changes rapidly. Thus, movement of the UI element may be smooth.

Switch between the first sensing mode and the second sensing mode may be determined in consideration of the amount of change of a measured distance with respect to a measurement target. For example, the switch between the first sensing mode and the second sensing mode may be determined by comparing the difference between the measured distance D and the zero-point distance $D_R$ with the reference distance. For example, when the amount of change of the measured distance with respect to the pin structure 25 is greater than the reference distance, the processor 4 may switch from the first sensing mode to the second sensing mode. On the other hand, when the amount of change of the measured distance with respect to the pin structure 25 is less than the reference distance, the processor 4 may switch from the second sensing mode to the first sensing mode. The reference distance may be greater than a measurement error of the sensor module 100. The reference distance may be less than the maximum distance Dmax. The reference distance may be about 1 mm to about 100 mm. The reference distance may be about 2 mm to about 50 mm.

Figure 19:
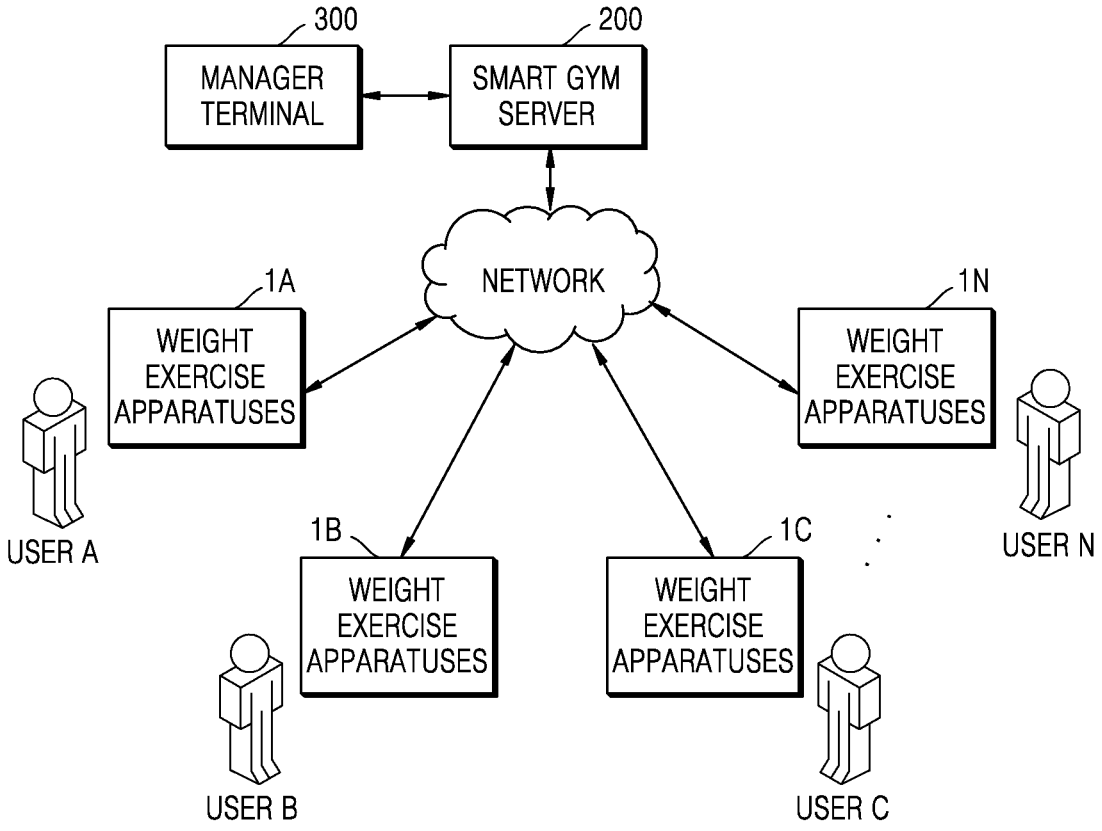
FIG. 19 is a view for describing a smart gym environment provided with a weight exercise apparatus according to an embodiment of the disclosure.

FIG. 19 is a view for describing a smart gym environment provided with the weight exercise apparatus 1 according to an embodiment of the disclosure.

Referring to FIG. 19, a plurality of weight exercise apparatuses 1A, 1B, 1C, and 1N are connected to a smart gym server 200 through a network. A manager such as a health trainer or a smart gym director may access the smart gym server 200 through a manager terminal 300.

Each of users USER A, USER B, USER C, and USER N coming to exercise at a smart gym may enter the smart gym after verifying an identify thereof using a user terminal such as a wearable device, a smart phone, etc., when entering and exiting the smart gym. For example, the user may enter or exit the smart gym after member verification by tagging the user terminal to an unmanned terminal such as a kiosk at the entrance of the smart gym in a near field communication (NFC) or radio frequency identification (RFID) manner. Information about a user whose membership has been verified may be transmitted from the smart gym server 200 to at least one of the weight exercise apparatuses 1A, 1B, 1C, and 1N through the network.

When the user accesses any one of the weight exercise apparatuses 1A, 1B, 1C, and 1N to tag a wearable device to the corresponding weight exercise apparatus 1, then the corresponding weight exercise apparatus 1 may automatically set an exercise program customized to an ability level and an exercise performance history of the user based on information received from the smart gym server 200.

The smart gym server 200 may store user information of a plurality of users, device information of the weight exercise apparatuses 1A, 1B, 1C, and 1N, and information used to operate other facilitates or the smart gym.

When the manager such as a health trainer registers the exercise program customized to the user in the manager terminal 300, exercise process information stored in the smart gym server 200 may be updated. The weight exercise apparatuses 1A, 1B, 1C, and 1N may receive the exercise process information from the smart gym server 200 connected through the network. Meanwhile, in the above-described embodiment, a shoulder press for strengthening a shoulder has been described as an example of the exercise main body 2, but any exercise equipment for weight exercises may be applied variously, without being limited thereto.

An embodiment of the disclosure may be implemented in the form of a computer program executable on a computer through various components, and the computer program may be recorded on a computer-readable medium. The medium may include a hardware device specially configured to store and execute a program instruction, like a magnetic medium such as a hard disk, a floppy disk, and a magnetic tape, an optical recording medium such as a CD-ROM and a DVD, a magneto-optical medium such as a floptical disk, ROM, RAM, flash memory, etc. Moreover, the medium may include intangible media implemented in a form transmittable on a network, and may be, for example, a medium implemented in the form of software or an application that may be transmitted and distributed through a network.

Meanwhile, the computer program may be a program command specially designed and configured for the disclosure or a program command known to be used by those skilled in the art of the computer software field. Examples of the computer program may include not only a machine language code created by a complier, but also a high-level language code executable by a computer using an interpreter.

With a weight exercise apparatus and a sensor module used therein according to an embodiment of the disclosure, accurate measurement may be possible to efficiently guide a weight exercise and a price burden may be lowered.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A weight exercise apparatus comprising:

an exercise main body comprising a plurality of weight plates;

a sensor module configured to detect a weight setting of the exercise main body and movement of a weight plate of the plurality of weight plates;

a user interface unit configured to output a user interface screen;

a memory storing at least one instruction; and a processor configured to control the user interface unit to display a user interface element indicating an exercise state of a user corresponding to the detected movement on the user interface screen, by executing the at least one instruction, wherein the sensor module comprises:

a first laser sensor comprising a first measurement accuracy and a first measurement frequency to detect the weight setting of the exercise main body when the weight plate of the plurality of weight plates is in a stationary state; and a second laser sensor comprising a second measurement accuracy lower than the first measurement accuracy and a second measurement frequency higher than the first measurement frequency to detect movement of the weight plate of the plurality of weight plates when the weight plate of the plurality of weight plates is in a moving state.

2. The weight exercise apparatus of claim 1, wherein the first laser sensor is arranged to detect a position of a pin structure to detect the weight setting of the weight exercise apparatus.

3. The weight exercise apparatus of claim 2, wherein the second laser sensor is arranged to detect the position of the pin structure.

4. The weight exercise apparatus of claim 2, wherein the second laser sensor is arranged to detect a position that is different from the position measured by the first laser sensor.

5. The weight exercise apparatus of claim 4, wherein the second laser sensor is arranged to detect a position of a surface of the weight plate of the plurality of weight plates.

6. The weight exercise apparatus of claim 1, wherein the first measurement frequency is once to 10 times per second, and the second measurement frequency is 5 times to 200 times per second.

7. The weight exercise apparatus of claim 6, wherein the first measurement accuracy has an error range of 5 mm or less, and the second measurement accuracy has an error range of 15 mm or less.

8. The weight exercise apparatus of claim 1, wherein the processor is further configured to control the user interface unit to display the user interface element on the user interface screen according to information detected by the second laser sensor based on whether a position of the weight plate of the plurality of weight plates moves, by executing the at least one instruction.

9. The weight exercise apparatus of claim 2, wherein the first laser sensor is arranged to irradiate a laser beam toward a reference surface, when the pin structure is arranged on the weight plate of the plurality of weight plates, the pin structure is arranged between the reference surface and the first laser sensor and the laser beam irradiated from the first laser sensor is irradiated to the pin structure without being irradiated to the reference surface, and when an $N^{th}$ measured distance measured by the first laser sensor is matched to a maximum distance that is a distance between the first laser sensor and the reference surface, and an $(N+1)^{th}$ measured distance measured thereafter by the first laser sensor is less than the maximum distance, the processor is further configured to determine weight setting of the exercise main body based on the $(N+1)^{th}$ measured distance.

10. The weight exercise apparatus of claim 1, wherein the processor is further configured to, by executing the at least one instruction:

when a difference between a preset zero-point distance and a measured distance measured by the second laser sensor is greater than a reference distance, control the user interface unit to move a position of the user interface element based on the difference; and when the difference between the zero-point distance and the measured distance measured by the second laser sensor is less than or equal to the reference distance, control the user interface unit to maintain the position of the user interface element.

11. A sensor module to detect a weight setting of a weight exercise apparatus comprising a plurality of weight plates and movement of a weight plate of the plurality of weight plates, the sensor module comprising:

a first laser sensor comprising a first measurement accuracy and a first measurement frequency to detect the weight setting of the weight exercise apparatus when the weight plate of the plurality of weight plates is in a stationary state; and a second laser sensor comprising a second measurement accuracy lower than the first measurement accuracy and a second measurement frequency higher than the first measurement frequency to detect movement of the weight plate of the plurality of weight plates when the weight plate of the plurality of weight plates is in a moving state.

12. The sensor module of claim 11, wherein the first laser sensor is arranged to detect a position of a pin structure configured to set a weight of the weight exercise apparatus.

13. The sensor module of claim 12, wherein the second laser sensor is arranged to detect the position of the pin structure.

14. The sensor module of claim 12, wherein the second laser sensor is arranged to detect a position that is different from the position measured by the first laser sensor.

15. The sensor module of claim 14, wherein the second laser sensor is further arranged to detect a position of a surface of the weight plate.

16. The sensor module of claim 11, wherein the first measurement frequency is once to 10 times per second, and the second measurement frequency is 5 times to 200 times per second.

17. The sensor module of claim 16, wherein the first measurement accuracy has an error range of 5 mm or less, and the second measurement accuracy has an error range of 15 mm or less.

18. A weight exercise apparatus comprising:

an exercise main body comprising a plurality of weight plates;

a sensor module configured to detect a weight setting of the exercise main body and movement of a weight plate of the plurality of weight plates;

a user interface unit configured to output a user interface screen;

a memory storing at least one instruction; and a processor configured to control the user interface unit to display a user interface element indicating an exercise state of a user corresponding to the detected movement on the user interface screen, by executing the at least one instruction, wherein the sensor module comprises:

a first sensing mode comprising a first measurement accuracy and a first measurement frequency to detect the weight setting of the exercise main body when the weight plate is in a stationary state; and a second sensing mode comprising a second measurement accuracy lower than the first measurement accuracy and a second measurement frequency higher than the first measurement frequency to detect movement of a weight plate of the plurality of weight plates when a weight plate of the plurality of weight plates is in a moving state.

19. The weight exercise apparatus of claim 18, wherein the sensor module is arranged to detect a position of a pin structure to detect the weight setting of the weight exercise apparatus.

* * * * *